US005437118A

United States Patent [19]

Sniezak et al.

[11] Patent Number: 5,437,118

[45] Date of Patent: Aug. 1, 1995

[54] FRAME PLUG FOR SEMI-AUTOMATIC HANDGUNS

[75] Inventors: Gary A. Sniezak, Windsor, Conn.; Edward P. Schmitter, Easthampton, Mass.

[73] Assignee: Smith & Wesson Corp., Springfield, Mass.

[21] Appl. No.: 207,349

[22] Filed: Mar. 7, 1994

[51] Int. Cl.[6] ..... F41C 23/10

[52] U.S. Cl. ..... 42/7

[58] Field of Search ..... 42/7, 71.02, 106

[56] References Cited

U.S. PATENT DOCUMENTS

| | | | |
|---|---|---|---|
| 932,183 | 8/1909 | Schwarzlose | 42/7 |
| 4,593,487 | 6/1986 | Ruger et al. | 42/7 |
| 5,058,301 | 10/1991 | Lishness et al. | 42/7 |

*Primary Examiner*—Stephen C. Bentley
*Attorney, Agent, or Firm*—Chapin, Neal & Dempsey

[57] ABSTRACT

A frame plug or closure member which is fitted into a cavity of a handgrip of a handgun is used to provide added reenforcement and to extend the handgrip. The plug has a tapered, semi-circular shaped base which is integrally connected to one end of a flexible flat, elongated member which has a foot at the other end thereof. The curvature of the base matches the curvature of the lower edge of the handgrip to provide a natural extension to the handgrip. The plug has a spine integrally connected to both the base and flexible elongated member so as to provide stiffness thereto. The handgrip has a plug cavity and an adjacent gun magazine cavity which open to the lower edge or butt thereof. The two cavities are separated by an internal wall having a through opening. The frame plug is fitted into the plug cavity until the foot reaches the opening at which time the foot snap fits into the opening thus securing the frame plug to the handgrip.

10 Claims, 2 Drawing Sheets

10
8
11
12
13
14
15
16
17
26
30

FRAME PLUG FOR SEMI-AUTOMATIC HANDGUNS

FIELD OF THE INVENTION

This invention relates to a frame plug or closure member for firearms and more particularly to a plug which is adapted to be fitted securely into a cavity in the butt of the handgrip of semi-automatic handguns.

BACKGROUND OF THE INVENTION

Semi-automatic handguns having integrally molded polymeric frames that typically have a generally hollow handgrip, the major portion of which provides a chamber used to accommodate a magazine. The remaining portion is in the form of a downwardly opening cavity located rearwardly of the magazine chamber. Other than certain advantages that accrue during the molding process, such as a substantial reduction in the amount of polymer needed to mold the frame and the ease in removing the frame from the mold in which it is formed, the cavity serves no useful purpose in the gun, per se. In its appearance as well as in the use of the gun, however, the open cavity is generally considered to be a serious drawback both from the standpoint of their appearance and operation and various means have been proposed to overcome such drawbacks.

U.S. Pat. No. 5,052,140 discloses a magazine guide which attaches to the butt of the handgrip to aid with the insertion of the magazine into the handgun. Additionally, a plug is fitted into the open cavity behind the magazine cavity.

SUMMARY OF THE INVENTION

Accordingly, it is an object of the present invention to provide a closure member and bumper to close a cavity in the handgrip portion of the handgun to assist in the protection of the gun and magazine against damage should the gun be dropped, for example.

It is another object to provide additional structural stability or stiffness to the handgrip portion of a molded polymeric frame of the gun.

It is yet another object to close off the plug cavity to prevent debris and dirt from entering the handgun.

It is another object to provide a buffer between the user's hand and the magazine to increase safety when loading the magazine into the handgun.

It is another object to provide comfort to the user by rounding off and extending the length of the butt of the handgun.

It is still a further object to provide an inexpensive, easily replaceable closure member should that member be damaged.

According to the present invention, a closure member which is adapted to be disposed within a cavity formed in the handgrip of a handgun comprises an elongated member having a base plug at the lower end thereof. The elongated member includes a first latch means at its upper end which is adapted to automatically engage a second latch means disposed on an internal wall separating the cavity and the adjacent magazine receiving chamber so that upon the interengagement of the first and second latch means, the base plug will be fitted into the lower end of the cavity to close the same.

The above and other objects and advantages of this invention will become more readily apparent when the following description is read in conjunction with the accompanying drawings.

DETAILED DESCRIPTION OF THE PREFERRED EMBODIMENTS

Figures 1, 2:
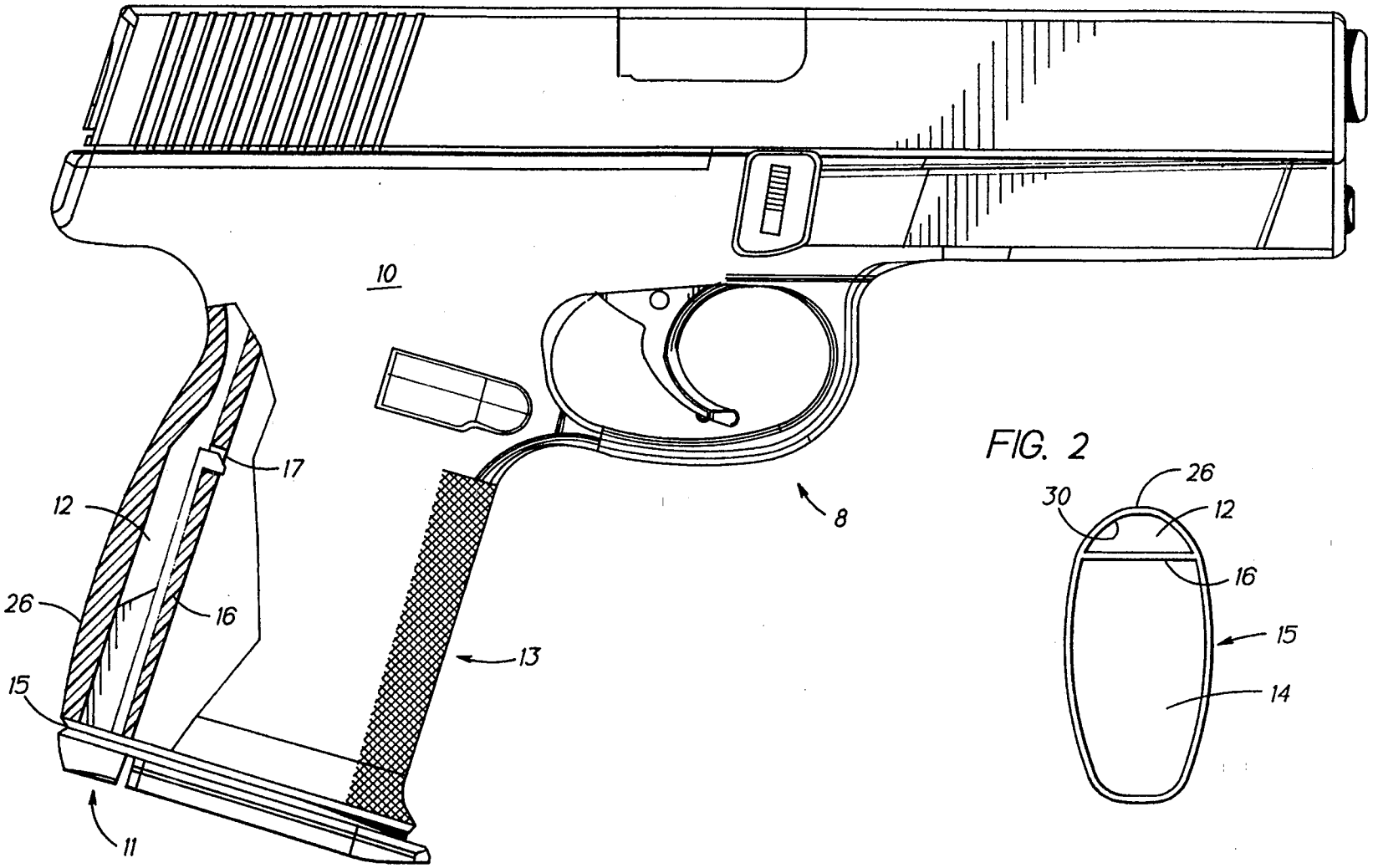
FIG. 1 is a partial cross-sectional elevational view of a handgun which incorporates the closure member of the present invention.
FIG. 2 is an elevational view of the butt of a handgrip of the handgun of FIG. 1.

As shown in FIGS. 1 and 2, a semi-automatic handgun 8 having a molded polymeric frame 10 is equipped with a closure member or frame plug 11 constructed to snap-fit into a cavity 12 of a handgrip 13. The plug cavity 12 being defined by the inner surface 30 of the back strap of the pistol handgrip and a transverse partition or wall 16 is of generally semi-circular shape adjacent to a gun magazine cavity or chamber 14. Both cavities are open at their lower end or butt end 15 of the handgrip and are separated by the partition or wall 16 which increases in thickness toward the upper end thereof. As a result of this construction, the distance between the surfaces 30 and wall 16 decreases progressively from the lower to the upper end of the cavity 12. An opening 17 is provided at a predetermined distance above the lower end of the cavity which serves as a first or female latch means for mating with a second or male latch means provided as part of the closure member 11.

Figures 3, 4, 5, 6, 7, 8, 9:
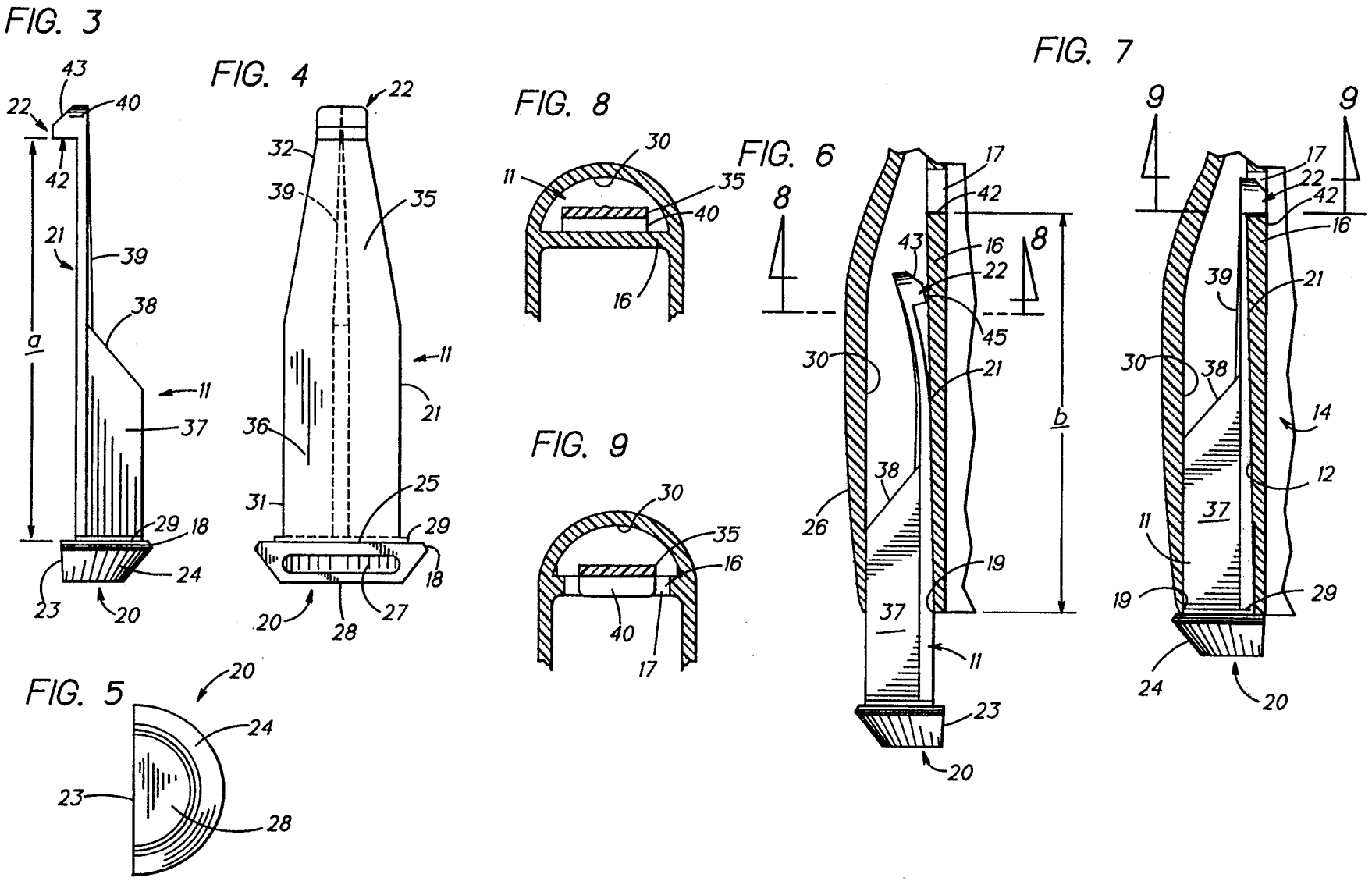
FIG. 3 is a side elevational view of the closure member.
FIG. 4 is a front elevational view of the closure member.
FIG. 5 is a bottom plan view of the closure member.
FIG. 6 is a cross-sectional view of the plug cavity of the handgrip with the closure having been partially inserted therein.
FIG. 7 is a cross-sectional view similar to FIG. 6 in which the closure member has been fully inserted into the cavity and latched therein.
FIG. 8 is a sectional view taken along line 8—8 of FIG. 6.
FIG. 9 is a sectional view taken along line 9—9 of FIG. 7.

Referring to FIGS. 3–5, the closure member 11 is preferably of integral construction formed by molding a polymeric material, such as a "NYLON 6/6" with an elastomer content to impart to the member a resilient-flexibility or spring-like quality. The closure member 11 comprises at its lower end, a foot or base portion 20 in the form of a base plug adapted to fit snugly into the lower end opening 19 of the cavity 12. From its base 20, the closure member includes an elongated resilient body portion or retainer 21 having a planar forward or front face 36 that extends from the upper surface of the base to the top or head thereof as at 22. The closure member includes a lower portion 31 of uniform width that extends upwardly from the base 20, an intermediate portion 35 that tapers in width inwardly toward the lower end of the head portion 22. The head includes a protruding nose 40 that extends forwardly of the planar surface of the elongated member and serves as a male latching member adapted to interengage with the opening 17 in the wall 16 to lock the closure member securely in place within the cavity, shown in FIGS. 1 and 7. Once so locked, the closure member is permanently maintained in a stationary position within the cavity and is generally incapable of being removed therefrom without the use of a tool or implement.

As illustrated in FIGS. 3–5, the base 20 is of a generally semi-circular configuration having a flat or planar undersurface 28, a straight side edge 23 and a conical side edge 24. As best shown in FIGS. 1 and 7, the curvature of the conical edge 24 is similar to the curvature of the backstrap 26 surface of the handgrip 13 and when fitted into the cavity 12, provides a neat and finished look at the terminal end thereof. The base 20 is preferably hollow with an opening 27 along the straight edge thereof. In addition to reducing the weight and amount of polymer needed to mold the closure member, the hollow base serves as a bumper to cushion or absorb any shocks the gun might be subjected to, such as by being dropped. The hollow base may also be filled with a foam elastomer material or a similar material to increase its shock absorbing capabilities. A chamfered edge 18 at the upper end 25 of the conical side edge of the base and the lower edge 15 of the handgrip provides a neat transition groove to the base 20. A thin shelf or ledge 29 is disposed on the upper surface of the base and its peripheral edge is adapted to fit within the lower end opening of the cavity 12, as best shown in FIG. 7, so as to securely seat the base or foot 20 into the lower end opening 19 of the cavity 12.

The elongated retainer 21 extends upwardly in generally a perpendicular relation from the upper surface 25 of the base 20 and is of a predetermined length a measured from the upper surface 25 of the base to the underside 42 (FIG. 3) of the nose 40. That length is approximately equal to distance b (FIG. 6) from the lower edge 19 of the wall 16 to the lower edge of the opening 17. With that dimensional relationship, the upper surface 25 of the base will engage the lower edge 19 of the cavity 12 substantially simultaneously with the nose 40 fitting into the opening 17.

The lower body portion 31 of the elongated retainer member 21 is of a width that is slightly smaller than the width of the cavity 12 at its lower end. A fin-like flange or support 37 extends outwardly of the rear surface of the elongated member which serves as a stiffener and having a beveled upper edge 38 which also assists in guiding the closure member into the cavity 12.

A spine 39 extends longitudinally along the rear surface of the tapered intermediate portion 35 of the elongated closure member 32 and it extends from the upper end of the fin 37 to the head portion 22 thereof. The spine 39 diminishes in height and width from its lower to its upper end so that the intermediate portion of the elongated member has incrementally greater flexibility or less stiffness at the upper end while conversely having greater stiffness the lower end thereof. Accordingly, as the member is being moved upwardly into the cavity 12, as illustrated in FIG. 6, the nose 40, while being urged by the resilient member into engagement with the surface of the wall 16, will slide readily thereover because at its head, the member, though resilient, has sufficient flexibility to effectively minimize the frictional drag between the two surfaces. Nonetheless, the nose portion 40 of the elongated member will still be urged biased against the wall to ensure that upon reaching that point, it will snap into the opening 17. The fin 37 and nose 40 are each provided with a beveled upper surface 38 and 43 to provide a lead angle to facilitate in fitting the member into the cavity. Referring to FIG. 7, the nose protrudes a distance which is less than the width of the inner wall 16 of the opening 17 so that it will not extend into the gun magazine cavity 14.

The closure member 11 is inserted into the plug cavity 12 and oriented so that the conical edge 24 of the base 20 is aligned with the back strap 26 of the handgrip 13. The configuration of the elongated member 21 and the fin 37 requires the frame plug to be properly oriented with the semi-circular shape of the lower end 19 of the plug cavity 12. As best shown in FIGS. 6 and 7, as the elongated member 21 is fitted head first into the cavity 12 and the outer surface 45 of the nose 40 slides along the internal wall 16, the elongated member remains in a relatively relaxed condition. Because of the gradual increase of the thickness of the wall 16, as best illustrated in FIG. 7, the plug cavity gradually narrows so that as the lower portion of the member is moved deeper into the cavity 12 with its nose 40 engaged with the surface of the wall 16, the tapered intermediate portion 35 will be flexed outwardly. The flexure of the elongated member forces the nose 40 against the wall 16 so that upon reaching the opening 17, it will snap therein thus interlocking the closure member 11 to the handgrip 13 with the undersurface 42 of the nose engaged with the lower edge of the opening 17. As best shown in FIG. 1, that while the nose protrudes sufficiently to engage the wall 16 (FIG. 6) of the opening 17 to secure the plug permanently in place in the handgrip, it does not protrude into the adjacent magazine cavity 14 so as to interfere with the insertion and removal of the magazine. As previously discussed, when the head of the closure member interengages with the opening 17, the shelf 29 of the base or plug will also be latched or locked within the lower end of the cavity 12 within the handgrip of the gun.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A closure member for a cavity in the handgrip of a polymeric frame of a semi-automatic handgun, the cavity being open at its lower end and defined in part by a rear wall of a magazine receiving chamber, said wall including a first coupling means located at a predetermined distance above the lower end of the handgrip, said closure member comprising at its lower end a plug dimensioned and shaped to close the lower end opening of the cavity, and an elongated retainer extending upwardly from said plug a distance approximately the same as said predetermined distance and including a second coupling means at its upper end for interengagement with said first coupling means when said closure member is fitted into said cavity, said elongated retainer being resiliently flexible for urging said first coupling means into engagement with said second coupling means for holding said closure member in assembled relation in said cavity and means for stabilizing the closure member relative to said handgrip.

2. A closure member for a cavity in the handgrip of a polymeric frame of a semi-automatic handgun, the cavity being open at its lower end and defined in part by a rear wall of a magazine receiving chamber, said wall including a female latch member located on said wall a predetermined distance above the lower end of the handgrip, said closure member comprising at its lower end a plug dimensioned and shaped to close the lower end opening of the cavity, and an elongated retainer extending upwardly from said plug a distance approximately the same as said predetermined distance, said retainer having a male latch member adjacent its upper end for interengagement with said female latch member when said closure member is fitted into said cavity, said elongated retainer being resiliently flexible for urging said male latch member into engagement with said female latch member and means for stabilizing said closure member to prevent inadvertent disengagement of said latch members by movement of said member relative to the handgrip.

3. A closure member for a semi-automatic handgun as set forth in claim 2, and in which said means for stabilizing said closure member comprises a shelf portion on an upper surface of said plug which serves as a seat to interfit snugly within the lower opening of the cavity.

4. A closure member for a semi-automatic handgun as set forth in claim 3 and in which said plug has a cavity having an opening at the peripheral surface thereof.

5. A closure member for a semi-automatic handgun as set forth in claim 3, and in which said means for stabilizing said closure member against movement relative to the handgrip comprises a lower portion of said retainer which is of sufficient width to engage opposed inner wall portions of the cavity and including an upper portion which is tapered inwardly toward said second coupling means, the upper portion of said retainer being more flexible than its lower portion.

6. The closure member of claim 5, wherein said means for stabilizing said closure member further comprises a flange which extends in a direction normal to at least the lower portion of said retainer for engaging a wall portion of said cavity disposed between said opposed inner walls to stabilize the position of the closure member in said cavity and to reinforce the hand grip of said handgun.

7. A closure member for a semi-automatic handgun as set forth in claim 6 and in which said elongated retainer has a ridge longitudinally extending from said support to the upper end of said elongated retainer.

8. The closure member of claim 2, wherein the resiliency of said elongated retainer increases progressively from one end thereof to the other.

9. The closure member of claim 8, wherein said elongated retainer further comprises a relatively rigid lower portion.

10. The closure member of claim 8, wherein an upper portion of said elongated retainer is movable relative to said lower portion during insertion of said closure member into said cavity.

* * * * *